US006699327B2

(12) United States Patent
VanRossen

(10) Patent No.: US 6,699,327 B2
(45) Date of Patent: Mar. 2, 2004

(54) DOOR PAINTING TOOL AND METHOD

(76) Inventor: Katherine VanRossen, 2409 Cedar, Everett, WA (US) 98201

( * ) Notice: Subject to any disclaimer, the term of this patent is extended or adjusted under 35 U.S.C. 154(b) by 0 days.

(21) Appl. No.: 09/961,118

(22) Filed: Sep. 20, 2001

(65) Prior Publication Data

US 2003/0054111 A1 Mar. 20, 2003

(51) Int. Cl.[7] ..... B05C 21/00
(52) U.S. Cl. ..... 118/505; 118/504
(58) Field of Search ..... 160/368.1, 374; 52/632; 118/504, 505

(56) References Cited

U.S. PATENT DOCUMENTS 2,284,012 A * 5/1942 Paca ..... 52/213
4,411,219 A * 10/1983 Keith et al. ..... 118/505
4,445,563 A 5/1984 Meyeroff
4,620,503 A * 11/1986 Pullens ..... 118/505
5,306,861 A 4/1994 Amos et al.
5,345,989 A 9/1994 Brophy
5,462,243 A * 10/1995 Hart et al. ..... 244/121
5,924,469 A 7/1999 Whittemore
5,927,038 A 7/1999 Goldberg et al.
6,209,615 B1 4/2001 Whittemore

* cited by examiner

*Primary Examiner*—J. A. Lorengo
*Assistant Examiner*—Michelle A Lazor
(74) *Attorney, Agent, or Firm*—Jensen & Puntigam, P.S.

(57) ABSTRACT

An apparatus and method of finishing doors that have been hung, including a lightweight, collapsible, portable tool which surrounds the door, preventing over spray. The tool is moved to the door, adjusted to size, and the door is finished.

5 Claims, 4 Drawing Sheets

DOOR PAINTING TOOL AND METHOD

TECHNICAL FIELD

This invention relates to a door painting tool, and more particularly to an adjustable, portable, collapsible frame element to be fitted around the outline of a hung door, such that the door may be finished in place, and the tool defining the critical surface prevents any over spray. The use of this tool allows the doors to be finished after they have been hung and after other subcontractors have left, permitting a more rapid finishing of the doors because of less drying time and also reduces the possibility of damage subsequent to the finishing.

BACKGROUND OF THE INVENTION

Traditionally, when a large building is constructed, the doors are by and large uniform, and the finishing of the doors is relegated to a relatively small enclosed area set aside for this purpose. The disadvantages of the traditional method of finishing the doors are multi-fold, including the fact that a large number of doors are in a small space, therefore there is limited air circulation which greatly increases the drying time, increasing the time span for the second or subsequent coat, as well as delaying the time of hanging the door. Further, since the doors are hung during the time that other subcontractors are finishing their tasks, there is a far greater danger of damage to the door during the transport and hanging process, as well as the time remaining until the other subcontractors are finished with their work.

By hanging the doors before they are finished and finishing them following completion of the work by other subcontractors, the danger of damage to the door is minimized and the fact that the doors are finished in place without the presence of other subcontractors, means that the door finishing task itself can be done expeditiously. This finishing process is greatly aided through the use of the inventive tool disclosed herein, which allows the finisher to move rapidly from door to door with the tool without a great deal of additional prep. Because of the greater air circulation, the doors dry relatively quickly.

Prior art known to the applicant includes:

U.S. Pat. No. 4,445,563, granted to Meyerhoff on May 1, 1984, which discloses a window structure wherein the support structure is made variable in size by using telescopically nested angle members. A flexible sheet extends across the support structure to provide weather protection.

U.S. Pat. No. 5,306,861, granted to Amos et al on Apr. 26, 1994 discloses a flexible, temporary wall covering, including a flexible sheet which may be adhesively secured to a portable frame work.

U.S. Pat. No. 5,345,989, granted to Brophy on Sep. 13, 1994, discloses a dust guard mounting, wherein a temporary frame work having securement means for a sheet member is placed over an opening to prevent the passage of dust therethrough.

U.S. Pat. No. 5,924,469, granted to Whittemore on Jul. 20, 1999, discloses telescopically expanding poles used to secure a flexible sheet defining a protected area within a predefined space.

U.S. Pat. No. 5,927,038, granted to Goldberg et al on Jul. 27, 1999, discloses an expandable self-locking frame used for construction of temporary walls, and the frame comprises a plurality of longitudinally extensible studs running along the length of a pair of elongated tracks, allowing the size of the framework to be adjusted.

U.S. Pat. No. 6,209,615 B1, granted to Whittemore on Apr. 3, 2001, discloses the same material as found in U.S. Pat. No. 5,924,469.

SUMMARY OF THE INVENTION

The present invention described in greater detail hereinafter includes a method and apparatus for finishing doors once they are mounted into their framework, and includes a tool which is adjustable both in height and in width to a dimension which surrounds the door, and when in place, prevents over spray during the time the door is finished. Of course the frame and the hardware are masked, but the door requires no additional preparation prior to finishing, and since the door is usually physically separated from other doors being finished, the dry time is greatly enhanced over the prior closed room method of finishing a plurality of doors. Once the door has been given its coating, the tool is moved to the next door and the process is repeated. Although the door tool is adjustable to meet different size doors, most of the doors in any given building structure will be the same size so that the tool can be moved from door to door without even having to be adjusted. There is also a provision in the present apparatus for detachable feet and the possibility of detachable arms to support draping if such is felt necessary.

The door tool described herein is designed to be quickly and easily adjusted and/or collapsed so that it may be easily carried from job to job or from door to door.

The tool is best used when the other subcontractors have completed their tasks and the door finishing can be done in an essentially empty and clean building such that there is no impediment to moving the tool from door to door, and further, there is no possibility of extraneous dust and/or damage to the finished door.

BEST MODE FOR CARRYING OUT THE INVENTION

Figure 1:
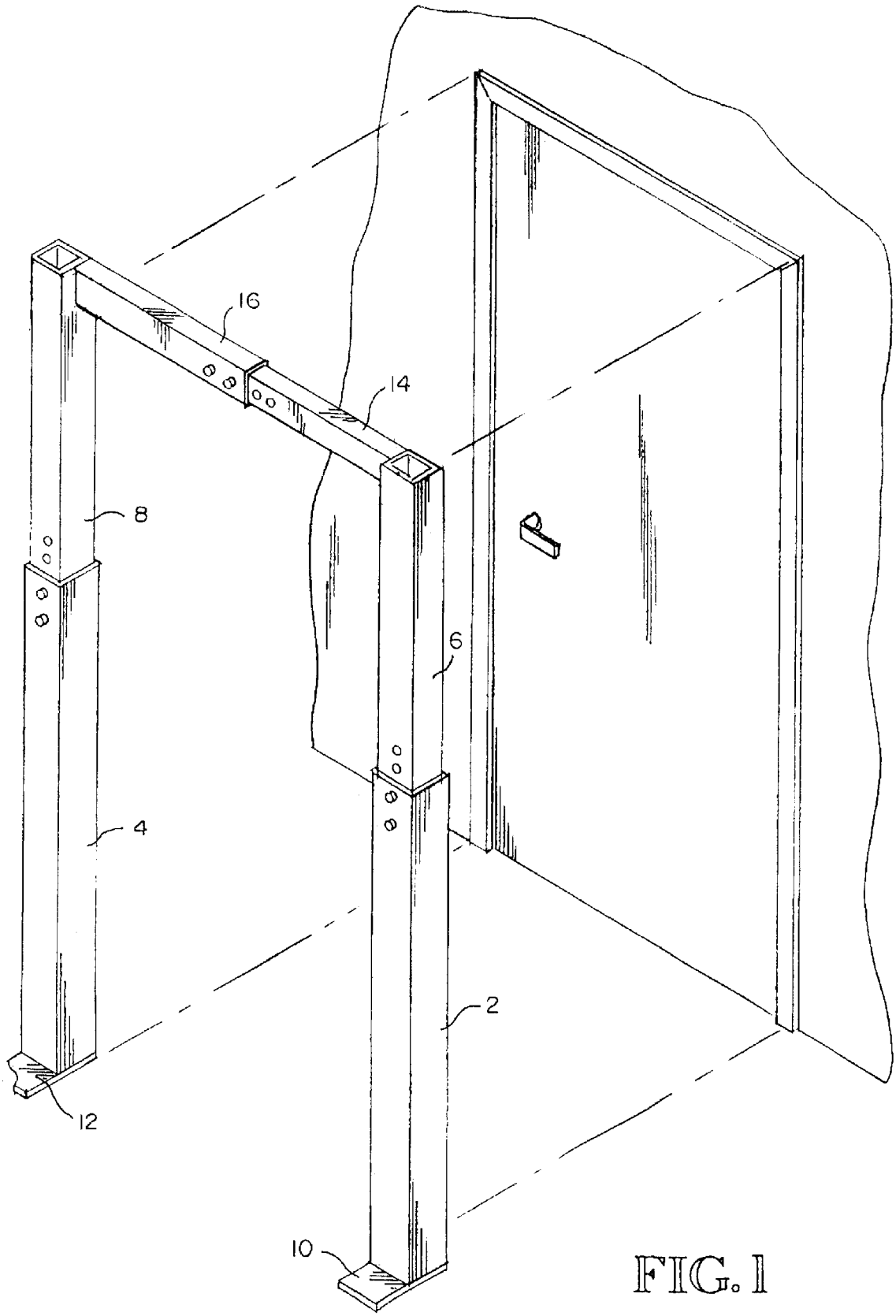
FIG. 1 depicts the assembled door tool ready to be placed adjacent a door.

As seen in FIG. 1, the inventive tool includes a pair of rectangular uprights 2 and 4 which host telescopic extensions 6 and 8, making the height of the tool adjustable to fit the door to be finished. Mounted to the bottom of the uprights 2 and 4 in a manner to be explained hereinafter are feet members 10 and 12 to stabilize the tool when in use. Detachably secured to the upper portion of the telescope members 6 and 8 is an adjustable horizontal member 14, 16 which again adjusts to the desired size and extends between and is removably secured to the uprights 6 and 8.

Figure 2:
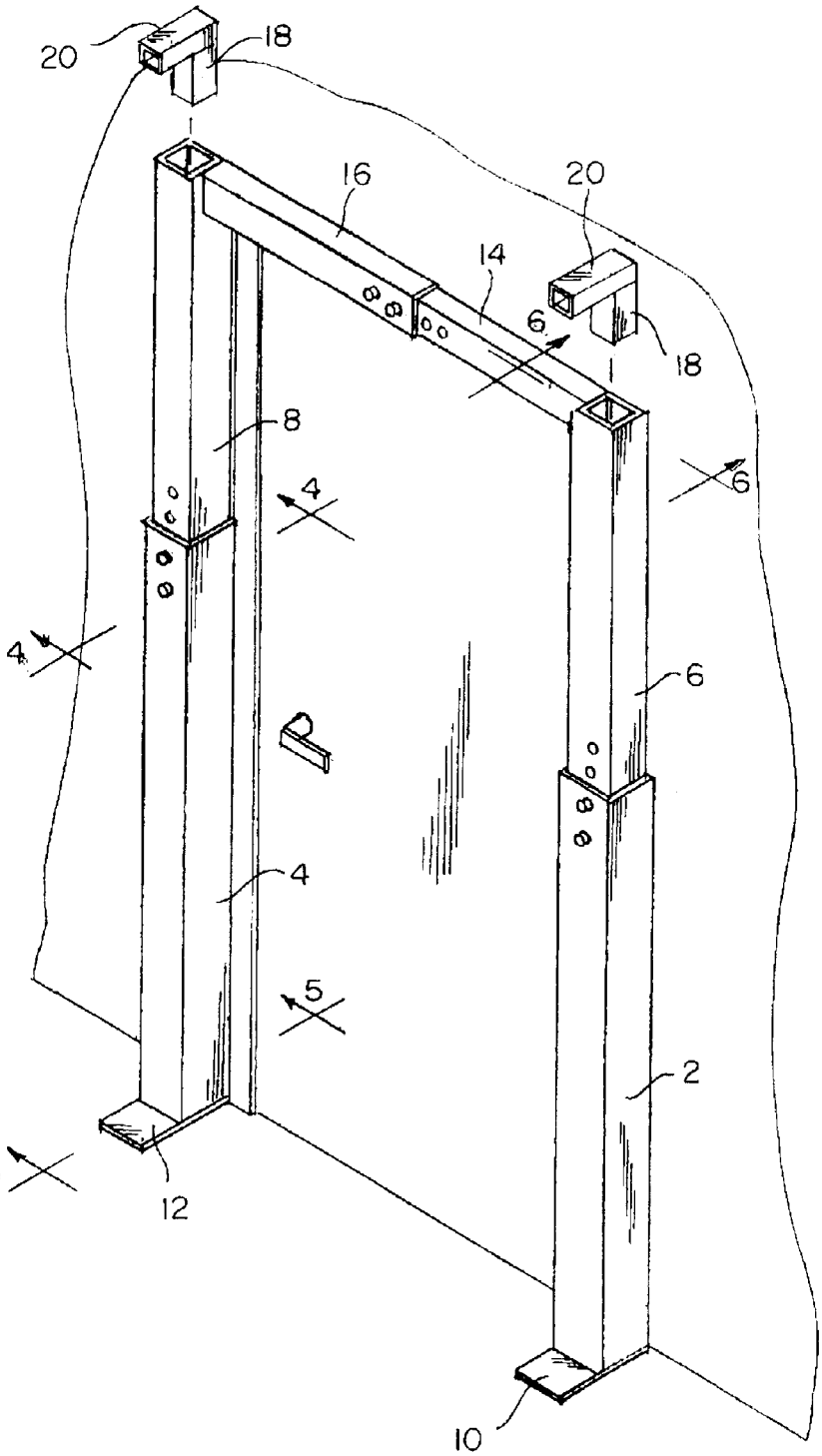
FIG. 2 depicts an alternate embodiment of the door tool in place adjacent the door.

Reference is now had to FIG. 2 wherein identical identification numbers are used to depict identical parts, and the tool has been moved to a position adjacent the door frame in readiness for the finishing of the door. Likewise seen in this view is an extension designed to be plugged into the top of the uprights 6 and 8, extending away from the wall and the door over which a plastic drape or the like may be placed in the event that additional protection from over spray is needed. The rectangular plug 18 would extend into the top of the upright 6 or 8 with horizontal arm 20 extending outwardly therefrom. The length of the arm 20 will vary as to the size of drape necessary.

Figure 3:
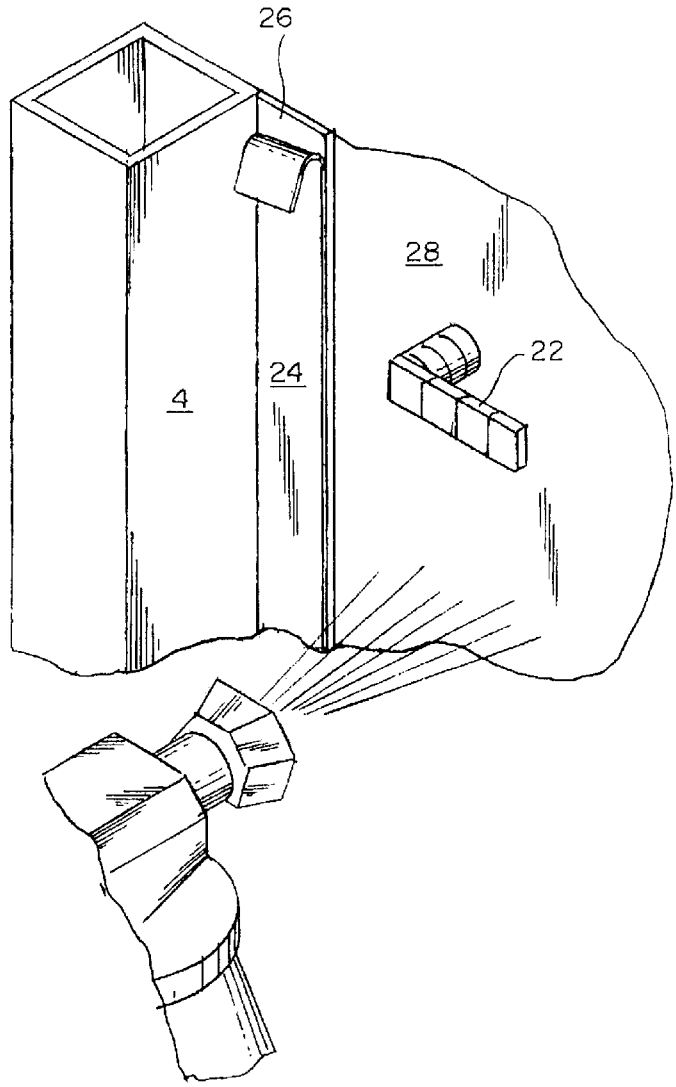
FIG. 3 depicts the method of use of the door tool of FIGS. 1 and 2.

Reference is now had to FIG. 3 which shows that suitable masking has been applied to the door handle 22 and likewise a strip 24 which extends behind the vertical 4 has been applied to the frame element 26, such that when the spray is applied to the door 28, those portions which are not desired to have the finish thereon have been covered and the tool as depicted by upright 4 prevents over spray to the surrounding walls.

Figure 4:
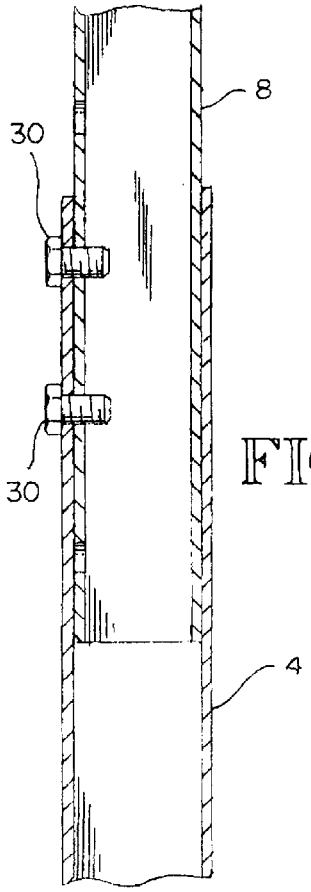
FIG. 4 illustrates a method of securing the telescopic uprights of FIG. 1 or 2.

As seen in FIG. 4, the telescoping members 4 and 8 are secured together by threaded fasteners 30, but could equally well be accomplished through the use of removable pins extending through the side walls of the rectangular elements, or alternatively by spring biased detents.

Figure 5:
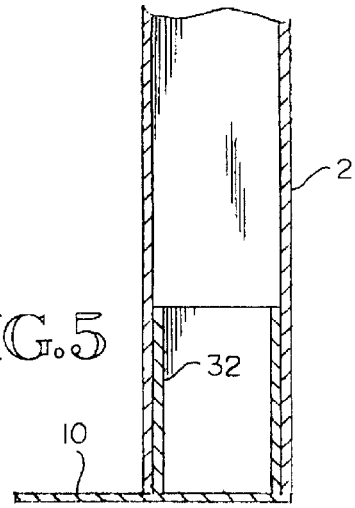
FIG. 5 illustrates a preferred embodiment of providing stabilizing feet for the embodiments of FIG. 1 or 2.

Reference is now had to FIG. 5 wherein it can be seen that the foot 10 is secured to a male member 32 which telescopically slides into upright 2 to improve stability.

Figure 6:
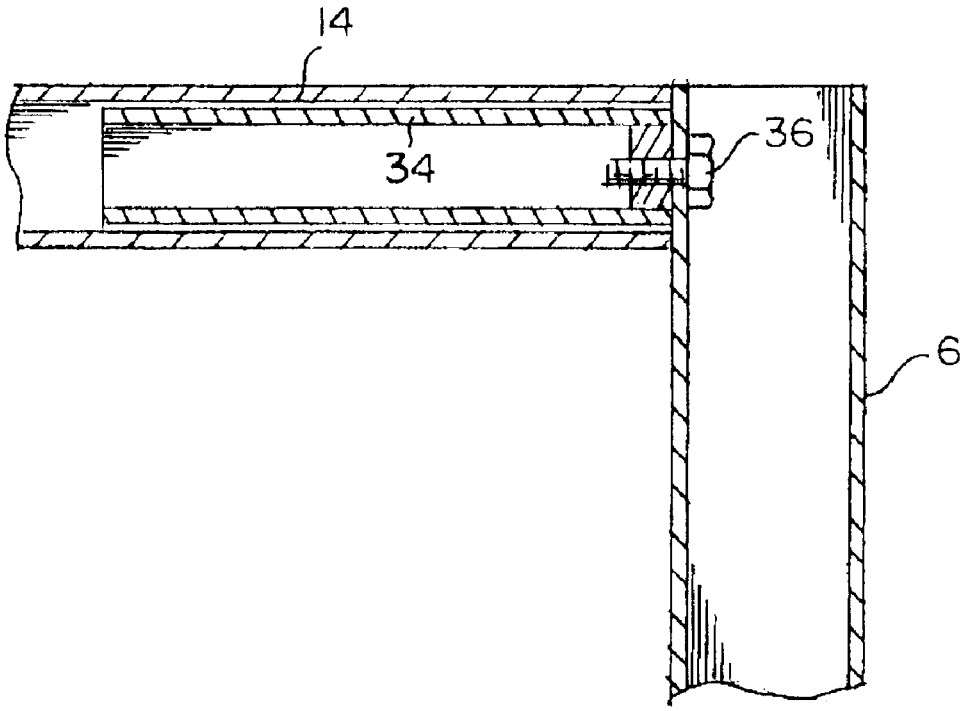
FIG. 6 illustrates the preferred method of securing the adjustable cross piece.

As seen in FIG. 6, the preferred method of securing the adjustable horizontal element represented by 14 is to telescopically place it over the stub piece 34 secured to the upright by bolt 36.

Thus, as can be seen, the tool when in use allows the builder to mount unfinished doors in their frames and quickly and easily finish them in position, greatly reducing the drying time because of greater air circulation than normal, and further, eliminates the possibility of damage by other subcontractors on the job, since it can be the last job performed before occupancy.

The use of the present tool allows the subcontract for finishing the doors to be done in far less time, and since it would be preferably done when the other subcontractors were finished, the total elapsed could be much more easily predicted.

What is claimed is:

1. An open bottom portable tool for use in finishing doors that have been hung comprising three rigid adjustable elements utilized together as a unit; two substantially identical vertical pieces adapted to be secured adjacent the edges of the door covering the frame and extending to the top of the frame, a third element removably secured to the tops of the two vertical pieces and covering the top of the frame such that the door may easily be finished without affecting the adjacent structure, and the tool easily moved to another site and another door.

2. A tool as in claim 1 wherein the adjustable members are telescoping.

3. A tool as in claim 1 wherein its vertical members include removable feet to stabilize the tool when in use.

4. A tool as in claim 1 wherein a pair of removable parallel arms extend outwardly from the tops of the vertical members to support flexible curtains.

5. A tool as in claim 1 wherein the tool is quickly and easily collapsed for transportation and storage.

* * * * *